US006019938A

United States Patent [19]

Underys et al.

[11] Patent Number: 6,019,938

[45] Date of Patent: Feb. 1, 2000

[54] HIGH DUCTILITY VERY CLEAN NON-MICRO BANDED DIE CASTING STEEL

[75] Inventors: Algirdas A. Underys, Arlington Hts; Guy A. Brada, Chicago, both of Ill.

[73] Assignee: A. Finkl & Sons Co., Chicago, Ill.

[21] Appl. No.: 09/065,220

[22] Filed: Apr. 23, 1998

[51] Int. Cl.[7] ..... C22C 38/22; C22C 38/24

[52] U.S. Cl. ..... 420/109; 420/111; 420/115

[58] Field of Search ..... 420/109, 111, 420/115; 75/512

[56] References Cited

U.S. PATENT DOCUMENTS 4,468,249 8/1984 Lehman ..... 420/109

5,244,626 9/1993 Finkl et al. ..... 420/109

5,720,829 2/1998 Finkl et al. ..... 148/326

5,888,450 3/1999 Finkl et al. ..... 420/109

*Primary Examiner*—Deborah Yee

*Attorney, Agent, or Firm*—James G. Staples

[57] ABSTRACT

A die casting die and a Cr—Mo—V steel therefore having an ultimate strength of 190,000 psi, a yield strength of 160,000, a tempering response of 400 BHN at a tempering temperature of 1150° F. and final gas contents of N—70 ppm, O—30 ppm and H—about 1.0 following a double vacuum melting process which includes vacuum arc degassing and vacuum arc remelt followed by annealing and heating in two stages to 1885° F., soaking, rapid quenching, tempering twice and stress tempering.

9 Claims, 2 Drawing Sheets

HIGH DUCTILITY VERY CLEAN NON-MICRO BANDED DIE CASTING STEEL

This invention relates to steels especially adapted for use in die casting applications including die casting die blocks and dies made therefrom, and methods of manufacture thereof. In its primary application of die casting it will be described in terms of the most rigorous of the die casting contexts, namely aluminum die castings.

BACKGROUND OF THE INVENTION

Aluminum die casting requires dies having both high strength and excellent toughness, the latter attribute equating generally to ductility. As is well known these attributes often tend to be offsetting in that high strength, generally with accompanying high hardness, is usually accompanied with a decrease in ductility, and vice versa. To obtain these two characteristics in the same steel therefore taxes the ingenuity of the steel producer to the limit, especially in view of the continued and increasing popularity of aluminum die casting. While zinc and magnesium die casting are also large industries, the provision of dies for these two uses are not as demanding as in the aluminum die casting industry since, of the three cast metals, aluminum is cast at the highest temperature, which may be in the region of 1200° F., and is very much more reactive at its casting temperature than either magnesium or zinc, the latter of which is usually cast at about 700° F. Accordingly attention has focused in recent years on developing steels and dies suitable for aluminum die casting; indeed, the commercial pressure has been so great that steel manufacturers and aluminum die casters have collaborated to establish standards to ensure that acceptable performance can be consistently obtained. Such standards, including *NADCA Recommended Procedures (for) H-13 Tool Steel*, published 1997, North American Die Casting Association, Rosemont, Ill., U.S.A., are very useful in introducing a degree of standards and standardization to the industry. However, only minimum acceptance standards have been promulgated and a wide area of improvement remains available for achieving near maximum performance out of the inherent maximum capabilities of the metals and available processing parameters.

In this connection the steel of choice for aluminum die casting is an AISI alloy, namely H-13, whose composition, as set out in ASTM A-681 Sec. 6 (as slightly modified for the die casting industry), is as follows:

| | |
|---|---|
| C | .37–.42 |
| Mn | .20–.50 |
| P | .025 max |
| S | .005 max |
| Si | .80–1.20 |
| Cr | 5.00–5.50 |
| V | .80–1.20 |
| Mo | 1.20–1.75 |

Although steels melted to this composition and processing in conformance with the above mentioned NADCA standards yield acceptable performance, said standards provide for permissible limits of microcleanliness; that is, severity levels of the Type A, B, C and D non-metallic inclusions. In addition, said standards, while requiring that the microstructure of the steel be free of excessive banding, does recognize acceptable levels of micro-banding (i.e.: microchemical segregation) in the steel.

Elimination of non-metallic inclusions is much to be preferred however because such compounds, in any amount, are undesirable since each inclusion holds the potential for being a stress raiser which could lead, eventually, to failure in service. By the same token elimination of micro-banding is much to be desired since, again, the presence of micro-banding to any significant extent holds the potential for the initiation and propagation of cracks in use. While it may be impossible to totally eliminate micro-banding (which is often referred to as alloy segregation), a distribution of the phenomena throughout the entire work piece and, further, diffusion uniformly, is greatly to be desired.

NADCA standards recognize the probability of the presence of inclusions and micro-banding but attempt to quantify limits in order to ensure good production performance. Thus, with respect to inclusions, the following permissible limits of microcleanliness have been promulgated for thin and heavy type inclusions.

Inclusions

| TYPE | THIN | HEAVY |
|---|---|---|
| A (sulfide) | 1.0 | 0.5 |
| B (aluminate) | 1.5 | 1.0 |
| C (silicate) | 1.0 | 1.0 |
| D (globular oxides) | 2.0 | 1.0 |

With respect to micro-banding eight levels of micro-banding have been defined, six of which—A, B, C, D, E and F—being acceptable, with G and H being unacceptable. Of the six acceptable levels, A is the most acceptable and F is the least acceptable. The die steel maker and the die steel user, while they will not reject material which is at level E or F, would much prefer that the material be at level B, or, even more desirably, at level A. It has been noted however that the conventional H-13 composition seldom receives a B level rating and only very rarely achieves an A level rating.

Hence a need exists in the die casting industry for a high strength, high ductility steel which is substantially inclusion free and segregation free, which meets the current industry standards and which can be made available to industry users at a competitive price.

SUMMARY OF THE INVENTION

The invention is a die casting steel, and a method of manufacture thereof, which is characterized by high ductility and high strength, is substantially or entirely inclusion free, and consistently meets the A level for micro-banding as defined by a widely recognized industry standard, said steel, and a tool, consisting of a die block and/or a die, having the following approximate composition:

| | |
|---|---|
| C | .33–.39 |
| Mn | .30–.45 |
| P | .025 max |
| S | .010 max |
| Si | .75–1.10 |
| Ni | .45 max |
| Cr | 4.75–5.25 |
| Mo | 2.70–3.00 |
| V | .24–.30 |
| Fe | balance Fe alone or in the presence of elements which do not adversely affect performance. |

In a more preferable form, the steel and tool is the product of a double vacuum process and has a final gas content of N—70 ppm or less, O—30 ppm or less and H—about 1.0 ppm or less.

In a further preferred embodiment the steel, together with the foregoing described characteristics, has the following approximate compositions:

| | |
|---|---|
| C | .33–.39 |
| Mn | .30–.45 |
| P | .020 max |
| S | .005 max |
| Si | .75–1.10 |
| Ni | .45 max |
| Cr | 4.75–5.25 |
| Mo | 2.70–3.00 |
| V | .24–.30 |
| Fe | balance, alone or in the presence of elements which do not adversely affect performance. |

In a yet further preferred embodiment, the steel, and tool is the product of a double vacuum process and has a final gas content of N—70 ppm or less, O—30 ppm or less and H—about 1.0 ppm more or less.

In the most preferred embodiment, the steel, together with the foregoing described characteristics, has the following aim composition:

| | |
|---|---|
| C | .36 |
| Mn | .35 |
| Si | .90 |
| Cr | 5.00 |
| Mo | 2.85 |
| V | .25 |
| Fe | balance, alone or in the presence of elements which do not adversely affect performance. |

BRIEF DESCRIPTION OF THE DRAWING

Certain aspects of the invention are clarified and expanded upon by reference to the drawing in which.

DESCRIPTION OF SPECIFIC EMBODIMENT

Figure 1:
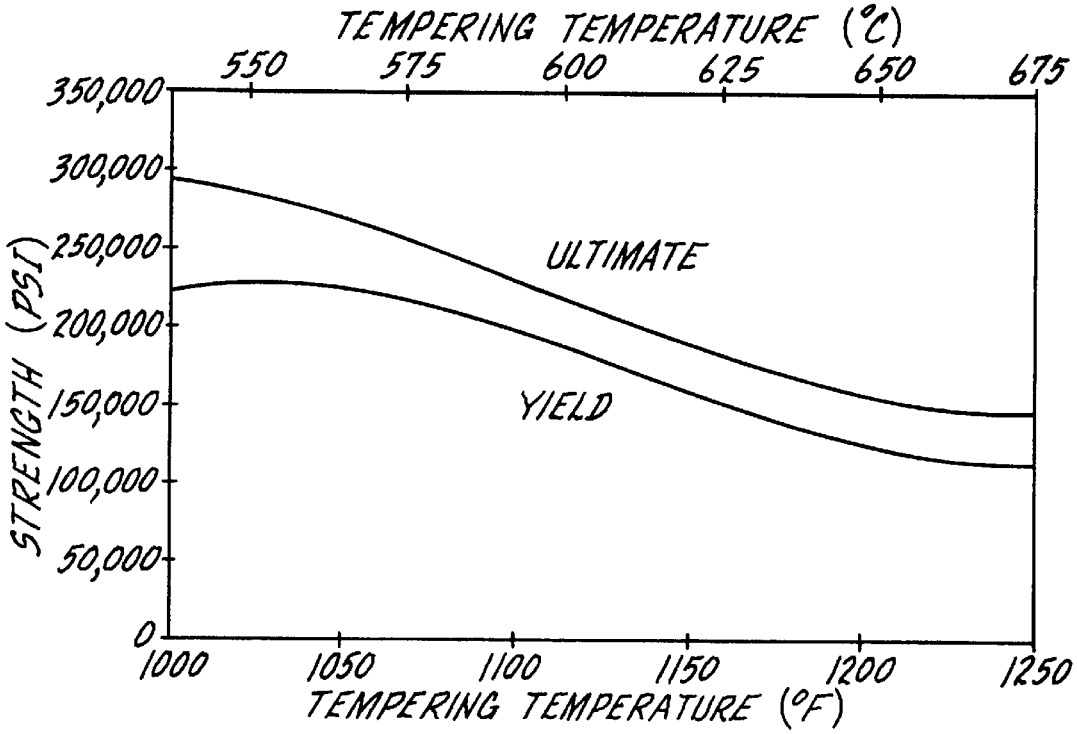
FIG. 1 illustrates the high strength of the invention steel as a function of tempering temperature.
Figure 2:
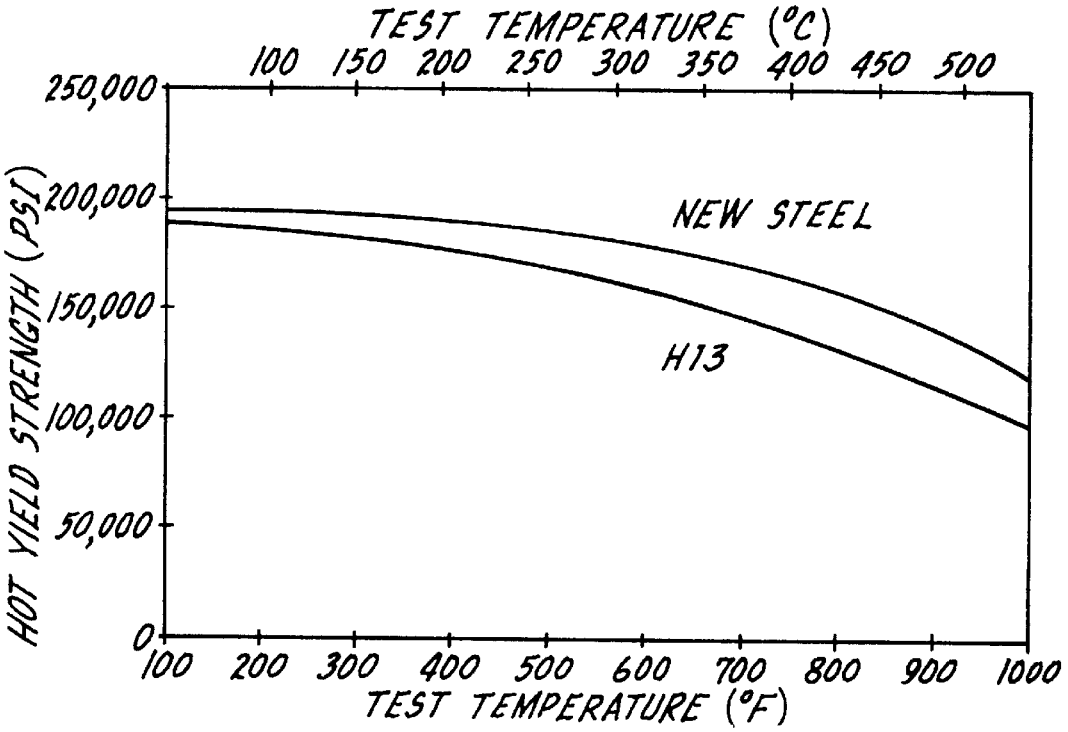
FIG. 2 illustrates the increased hot yield strength of the invention steel as contrasted to H-13.
Figure 3:
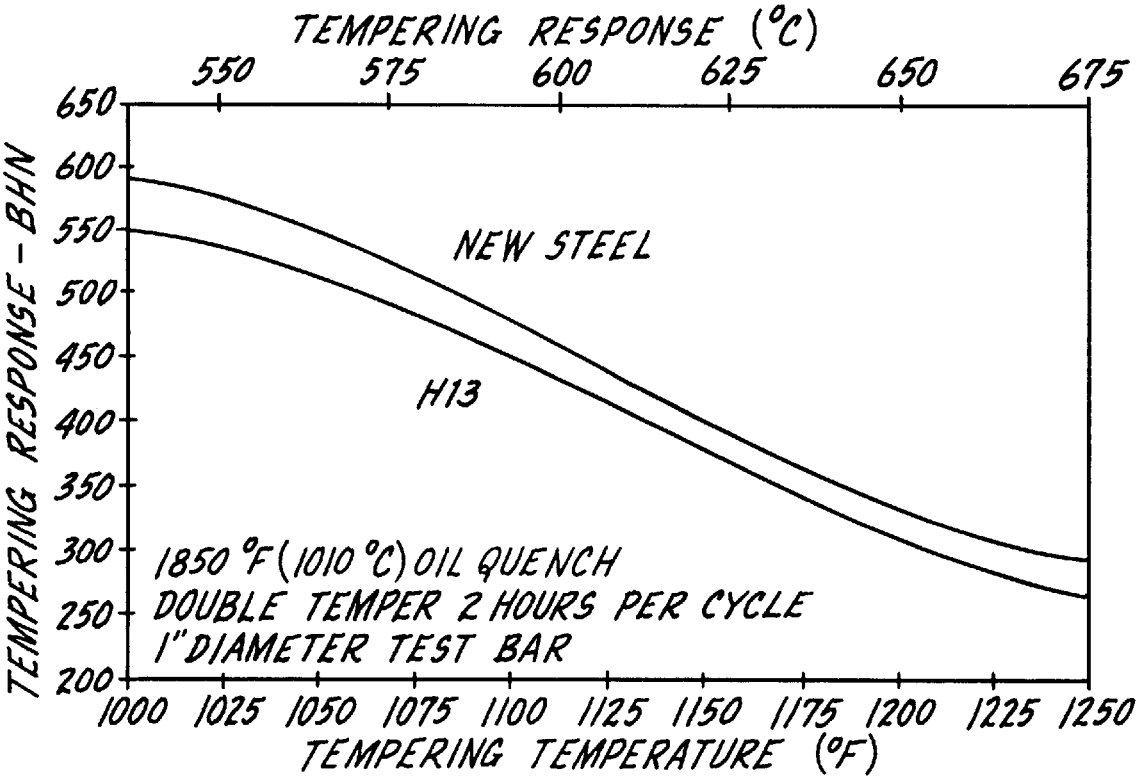
FIG. 3 illustrates the increased tempering response of the invention steel as contrasted to H-13.

Referring firstly to the compositional aspect of the invention, carbon enables the alloy to achieve the strength and hardness necessary to resist wear and thermal fatigue cracking in the ferrous alloy system. The carbon also forms hard, wear resistant carbides when combined with chromium, molybdenum, and vanadium. The range of 0.33 to 0.39 weight percent carbon is needed to achieve the desired strength and hardness characteristics. A higher carbon content would reduce the toughness and crack resistance of the alloy, and lower carbon contents would not be capable of achieving the strength necessary for the tool steel applications.

Manganese acts as a deoxidizer during refining and tends to combine with any sulfur present to form manganese sulfide inclusions (MnS). These MnS type inclusions are preferred over the sulfide inclusion types or free sulfur in the alloy, both of which can lead to embrittlement and hot-shortness during the hot working operations. Due to the nature of the double vacuum process to be described hereafter, manganese in the range of 0.30 to 0.50 weight percent is sufficient to form the preferred MnS type inclusions. It is preferred however that Mn be no greater than 0.45 to achieve consistent results.

Phosphorous is an impurity element that should be maintained below 0.025 weight percent to reduce embrittling effects, and preferably below 0.020 weight percent.

Sulfur should be maintained at or below 0.010 weight percent to ensure good polishability of the die and to avoid any adverse impact on the mechanical properties. A preferred composition of 0.005 weight percent maximum will ensure the minimum effect of sulfur on the toughness of the die steel.

Silicon acts as a deoxidizer during refining and improves the fluidity and castability of the molten metal. In the range of 0.75 to 1.10 weight percent there is sufficient silicon to effectively deoxidize the heat while strengthening the ferrite and, to a lesser degree, strengthening the austenite by solid solution strengthening. Silicon in this range also improves the high temperature oxidation resistance of this Cr—Mo—V steel which is a desirable attribute of this steel when used as a high temperature forming die.

Nickel is not added to the steel composition. The composition is limited to 0.45 weight percent maximum as an allowable residual amount. Since nickel stabilizes austenite contents, nickel in amounts above 0.45 would exhibit less favorable heat treated microstructures and properties.

Chromium combines with carbon to form hard, wear resistant chromium carbides that enhance the longevity of the tool steel dies. Chromium in this range also provides additional high temperature oxidation resistance and high temperature strength. Chromium levels higher than the designated range would reduce the toughness of the tool steel alloy and levels lower than the designated range would have inadequate hot strength and wear resistance.

Molybdenum increases the hardenability of the tool steel alloy which results in the development of properties through heavier cross-sections. Molybdenum, like chromium and vanadium, is a good carbide former and therefore enhances the high temperature strength and wear resistance of the alloy. Molybdenum retards softening of the tool steel alloy at the die operating temperatures which results in better wear resistance and long term heat checking resistance. Molybdenum in the designated range is also necessary to develop the high temperature strength and wear characteristics necessary for the tool steel applications.

The vanadium range is optimum to achieving the beneficial grain refinement and carbide formation effects of vanadium without the formation of massive, primary carbides. The formation of carbides is a beneficial characteristic of vanadium because it imparts wear resistance and high temperature strength to the tool steel alloy. However, when present in amounts greater than 0.30 weight percent large, primary carbides form during solidification that have been shown to reduce toughness and heat checking resistance of the alloy. The current alloy balances the reduced vanadium with increased molybdenum to achieve the benefits of carbide formation while minimizing the detrimental, primary vanadium carbides. This balanced combination of molybdenum and vanadium has exhibited 60% higher impact toughness over other grades.

The steel and tool made therefrom of the present invention is made by a double vacuum process. In said process a heat of steel, which may be assumed to be on the order of about 65–70 tons (though there is no known size limitation) is preferably melted in an electric furnace using a two stage process. The heat is tapped into a suitable container, usually a ladle, and subjected to a first vacuum treatment consisting of the simultaneous subjection to a vacuum sufficiently low to effectively remove deleterious gas and the upward passage of a purging agent, such as argon gas, which functions to bring portions of the melt which are remote from the surface to the surface where the included deleterious gasses H, N and O are subjected to, and removed by, the vacuum. During some portion or all of the subjection of the heat to the vacuum the heat is subject to the heating and other processing effects of an electric current heating arc, preferably an alternating current arc. Specific processing steps, including sequences, times, temperatures and final values can be found in U.S. Pat. No. 3,589,289, the description of which is incorporated herein by reference.

Following subjection to the above described first vacuum process the steel is teemed into an ingot mold and solidified.

After stripping from the ingot mold and conditioning, as needed, a stub shaft is welded on one end of the ingot and the conditioned ingot thereby converted into a vacuum arc remelt electrode.

The VAR electrode is then vacuum arc remelted in a water cooled copper mold in a vacuum arc remelt station utilizing standard operating times and other parameters which may include, for example, an absolute vacuum on the order of about 10–20 microns Hg and DC current. Following the VAR process material is forged into bar shapes which are subsequently annealed to final desired hardness of 235 BHN max. The annealed bar shapes are rough machined to remove surface decarburization and inspected.

Thereafter, and following other conventional processing such as rough machining and even sizing into small pieces, such as die blocks for aluminum or other die casting, or even into semi-finished dies, the resulting work pieces may be subjected to a hardening heat treatment by the following process and variations thereof, which processes may be similar to the processes described in the aforesaid NADCA publication.

For example, the following sequence of steps may be performed.

1. The work is loaded into a cold furnace and heated at a rate not to exceed 400° F. per hour.

2. The work is heated to 1000° F. to 1250° furnace temperature and held until the temperature of the surface of the work is less that 200° F. hotter than the temperature at the center. Surface and center temperatures may be determined from appropriately placed thermocouples.

3. Thereafter the work is heated to 1550±50° F. and held until the temperature at the surface is less than 200° F. hotter than the temperature at the center.

4. Thereafter the work is heated rapidly from 1550° F. to 1885±10° F.

5. The soak time should be 30 minutes after the temperature of the surface is less that 25° F. hotter than the temperature at the center or 90 minutes maximum after the temperature of the surface reaches 1885° F., whichever occurs first.

6. Thereafter the work is quenched as rapidly as possible to 850° F. as measured at the surface. A pressurized gas quench can be used although a water quench is preferred.

The minimum quenching rate should be 50° F./minute between 1885° F. and 1000° F. as measured at the surface, but the surface temperature should reach 1000° F. in less than 18 minutes. In dies with ruling sections greater than about 12 inches it may not be possible to achieve the recommended quench rate with all equipment.

7. In the event the difference between the surface and the center temperature is greater than 200° F. when the surface temperature reaches the 850° F.–750° F. range, the quench may be interrupted for an appropriate time, such as 15 minutes, but no more than 30 minutes, and thereafter rapid quench should be resumed until the surface temperature reaches 300° F.

8. The work must then be cooled until the temperature at the center reaches 150° F.

9. Thereafter a minimum of two tempering cycles should be carried out with the work cooled to ambient temperatures between temper cycles.

10. The finished dies should be stress tempered at 50° F. below the highest tempering temperature.

In supplement to the above, additional preheating steps may be used if believed appropriate. Further, tempering and stress tempering cycles should be held 20 minutes per inch of thickness based on the furnace thermocouple. Also, hold time after the furnace reaches setpoint should be two hours minimum or two hours minimum after core temperature reaches tempering temperature.

The preferable hardness range should be 42 to 50 HRC. The lower end of the range is appropriate for dies where gross cracking is of concern and the high end of the range is recommended for improved heat checking resistance.

If the work is subsequently machined or heat treated it may be stress relieved by charging into a cool (i.e.: less than 500° F.) furnace, heated to 1050° F. to 1250° F. with 20 minutes of heating for each inch of section thickness. Then the work should be held for at least ½ hour per inch of section thickness or a minimum of two hours once the furnace reaches operating temperature.

Simple shapes may be taken out and air cooled.

Complex shapes should be furnace cooled to 800° F. before air cooling.

Annealing may be performed if the work piece was incorrectly hardened or softened in service.

Although the invention has been described in detail it will at once be apparent to those skilled in the art that modifications can be made within the spirit and scope of the invention. Accordingly, it is intended that the scope of the invention not be limited by the foregoing exemplary description, but rather only by the scope of the hereafter appended claims when interpreted in light of the relevant prior art.

It is claimed:

1. As a product, an alloy steel having high strength, excellent toughness, a low level of non-metallic inclusions, and minimal micro-chemical segregation, and having the following approximate chemical composition:

| | |
|---|---|
| C | .33–.39 |
| Mn | .30–.50 |
| P | .025 max |
| S | .010 max |
| Si | .75–1.10 |
| Ni | .45 max |
| Cr | 4.75–5.25 |
| Mo | 2.70–3.00 |
| V | .24–.30 |
| Fe | balance alone or in the presence of elements which do not adversely affect performance |
| N | 70 ppm max |
| O | 30 ppm max |
| H | about 1 ppm max |

said product being the product of a process having the steps of forming a heat of steel in an electric furnace by a two stage process, subjecting the heat to a vacuum treatment consisting of the simultaneous subjection to a vacuum sufficiently low to effectively remove deleterious gases and the upward passage of a purging agent, subjecting the heat at some time while under vacuum to the heating effect of an electric current arc, solidifying the steel, forming the solidified steel into a vacuum arc remelt electrode, vacuum arc remelting the electrode utilizing DC current, and solidifying the resultant product.

2. An alloy steel having the following approximate composition:

| | |
|---|---|
| C | .33–.39 |
| Mn | .30–.50 |
| P | .025 max |
| S | .010 max |
| Si | .75–1.10 |
| Ni | .45 max |
| Cr | 4.75–5.25 |
| Mo | 2.70–3.00 |
| V | .24–.30 |
| Fe | balance alone or in the presence of elements which do not adversely affect performance |
| N | 70 ppm max |
| O | 30 ppm max |
| H | about 1 ppm max |

said composition being substantially free of non-metallic inclusions.

3. The alloy steel of claim 2 further characterized in that

| | |
|---|---|
| Mn | .30–.45 |
| P | .020 max |
| S | .005 max. |

.

4. The alloy steel of claim 2 further characterized in that said steel is the product of a double vacuum process, said double vacuum process including the steps of forming a heat of alloy steel in a melting unit to substantially the foregoing composition, thereafter subjecting said heat to a first vacuum process consisting of the simultaneous subjection to a vacuum sufficiently low to effectively remove the deleterious gases and the upward passage of a purging agent which functions to bring portions of said heat which are remote from the surface to the surface whereby substantial quantities of included deleterious gases may be removed by the vacuum and during some portion, or all, of the subjection of the heat to the aforementioned vacuum additionally subjecting the heat to an electric current heating arc, and, thereafter, and following solidification, remelting said solidified steel in a vacuum arc remelt furnace until the aforementioned gas content are attained.

5. The alloy steel of claim 4 further characterized in that

| | |
|---|---|
| Mn | .30–.45 max |
| P | .020 max |
| S | .005 max. |

.

6. A die casting die having high strength, excellent toughness, a low level of non-metallic inclusions and minimal micro-chemical segregation, said micro-chemical segregation, when present, being diffused substantially uniformly throughout the die, said die having the following approximate composition:

| | |
|---|---|
| C | .33–.39 |
| Mn | .30–.50 |
| P | .025 max |
| S | .010 max |
| Si | .75–1.10 |
| Ni | .45 max |
| Cr | 4.75–5.25 |
| Mo | 2.70–3.00 |
| V | .24–.30 |
| Fe | balance alone or in the presence of elements which do not adversely affect performance |
| N | 70 ppm max |
| O | 30 ppm max |
| H | about 1 ppm max. |

.

7. The die of claim 6 further characterized in that the die is an aluminum die casting die.

8. The die of claim 6 further characterized in that

| | |
|---|---|
| Mn | .30–.45 |
| P | .020 max |
| S | .005 max |

.

9. The die of claim 8 further characterized in that the die is an aluminum die casting die.

* * * * *